US006230122B1

(12) United States Patent
Wu et al.

(10) Patent No.: US 6,230,122 B1
(45) Date of Patent: May 8, 2001

(54) SPEECH DETECTION WITH NOISE SUPPRESSION BASED ON PRINCIPAL COMPONENTS ANALYSIS

(75) Inventors: Duanpei Wu, Sunnyvale; Miyuki Tanaka, Campbell; Mariscela Amador-Hernandez, San Jose, all of CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 0 days.

(21) Appl. No.: 09/176,178

(22) Filed: Oct. 21, 1998

Related U.S. Application Data

(60) Provisional application No. 60/099,599, filed on Sep. 9, 1998.

(51) Int. Cl.[7] ..... G10L 21/02

(52) U.S. Cl. ..... 704/226; 704/204; 704/233

(58) Field of Search ..... 704/233, 226, 704/227, 204

(56) References Cited

U.S. PATENT DOCUMENTS

| | | | |
|---|---|---|---|
| 4,592,085 | 5/1986 | Watari et al. | 381/43 |
| 4,630,304 | 12/1986 | Borth et al. | 381/94.3 |
| 4,910,716 | 3/1990 | Kirlin et al. | 367/24 |
| 4,951,266 | 8/1990 | Hsu et al. | 367/25 |
| 5,003,601 | 3/1991 | Watari et al. | 381/43 |
| 5,093,899 | 3/1992 | Hiraiwa | 395/23 |
| 5,212,764 | 5/1993 | Ariyoshi | 704/233 |
| 5,301,257 | 4/1994 | Tani | 395/11 |
| 5,485,524 | 1/1996 | Kuusama et al. | 381/94.3 |
| 5,513,298 | 4/1996 | Stanford et al. | 395/2.52 |
| 5,615,296 | 3/1997 | Stanford et al. | 395/2.1 |
| 5,699,480 * | 12/1997 | Martin | 704/205 |
| 5,715,367 | 2/1998 | Gillick et al. | 395/2.63 |
| 5,806,025 | 9/1998 | Vis et al. | 704/226 |

OTHER PUBLICATIONS

Haykin, Simon, "Neural Networks," 1994, pp. 363–370.

Ephraim et al., A Signal Subspace Approach For Speech Enhancement, Jul. 1995, pp. 251–266 IEEE Trans. Speech and Audio Proc., vol. 3 Iss.4.

Lee et al., Image Enhancement Based On Signal Subspace Approach, Aug. 1999, pp 1129–1134, IEEE Trans. Image Proc., vol. 8, Iss.8.

Ephraim et al., A Spectrally–Based Signal Subspace Approach For Speech Enhancement, May 1995, pp 804–807, 1995 Int. Conf. Acoust. Speech Sig. Proc., ICASSP–95, vol. 1.

* cited by examiner

*Primary Examiner*—William R. Korzuch
*Assistant Examiner*—Donald L. Storm
(74) *Attorney, Agent, or Firm*—Gregory J. Koerner; Simon & Koerner LLP

(57) ABSTRACT

A method for effectively suppressing background noise in a speech detection system comprises a filter bank for separating source speech data into discrete frequency sub-bands to generate filtered channel energy, and a noise suppressor for weighting the frequency sub-bands to improve the signal-to-noise ratio of the resultant noise-suppressed channel energy. The noise suppressor preferably includes a subspace module for using a Karhunen-Loeve transformation to create a subspace based on the background noise, a projection module for generating projected channel energy by projecting the filtered channel energy onto the created subspace, and a weighting module for applying calculated weighting values to the projected channel energy to generate the noise-suppressed channel energy.

16 Claims, 8 Drawing Sheets

SPEECH DETECTION WITH NOISE SUPPRESSION BASED ON PRINCIPAL COMPONENTS ANALYSIS

CROSS-REFERENCE TO RELATED APPLICATIONS

This application is related to, and claims priority in, co-pending U.S. Provisional Patent Application Serial No. 60/099,599, entitled "Noise Suppression Based On Principal Components Analysis For Speech Endpoint Detection," filed on Sept. 9, 1998. This application is also related to co-pending U.S. patent application Ser. No. 08/957,875, entitled "Method For Implementing A Speech Recognition System For Use During Conditions With Background Noise," filed on Oct. 20, 1997, and to co-pending U.S. patent application Ser. No. 09/177,461, entitled "Method For Reducing Noise Distortions In A Speech recognition System," filed on Oct. 22, 1998. All of the foregoing related applications are commonly assigned, and are hereby incorporated by reference.

BACKGROUND OF THE INVENTION

1. Field of the Invention

This invention relates generally to electronic speech detection systems, and relates more particularly to a method for suppressing background noise in a speech detection system.

2. Description of the Background Art

Implementing an effective and efficient method for system users to interface with electronic devices is a significant consideration of system designers and manufacturers. Human speech detection is one promising technique that allows a system user to effectively communicate with selected electronic devices, such as digital computer systems. Speech generally consists of one or more spoken utterances which each may include a single word or a series of closely-spaced words forming a phrase or a sentence. In practice, speech detection systems typically determine the endpoints (the beginning and ending points) of a spoken utterance to accurately identify the specific sound data intended for analysis.

Conditions with significant ambient background-noise levels present additional difficulties when implementing a speech detection system. Examples of such noisy conditions may include speech recognition in automobiles or in certain manufacturing facilities. In such user applications, in order to accurately analyze a particular utterance, a speech recognition system may be required to selectively differentiate between a spoken utterance and the ambient background noise.

Referring now to FIG. 1(*a*), an exemplary waveform diagram for one embodiment of noisy speech 112 is shown. In addition, FIG. 1(*b*) depicts an exemplary waveform diagram for one embodiment of speech 114 without noise. Similarly, FIG. 1(*c*) shows an exemplary waveform diagram for one embodiment of noise 116 without speech 114. In practice, noisy speech 112 of FIG. 1(*a*) is therefore typically comprised of several components, including speech 114 of FIG. (1(*b*) and noise 116 of FIG. 1(*c*). In FIGS. 1(*a*), 1(*b*), and 1(*c*), waveforms 112, 114, and 116 are presented for purposes of illustration only. The present invention may readily function and incorporate various other embodiments of noisy speech 112, speech 114, and noise 116.

An important measurement in speech detection systems is the signal-to-noise ratio (SNR) which specifies the amount of noise present in relation to a given signal. For example, the SNR of noisy speech 112 in FIG. 1(*a*) may be expressed as the ratio of noisy speech 112 divided by noise 116 of FIG. 1(*c*). Many speech detection systems tend to function unreliably in conditions of high background noise when the SNR drops below an acceptable level. For example, if the SNR of a given speech detection system drops below a certain value (for example, 0 decibels), then the accuracy of the speech detection function may become significantly degraded.

Various methods have been proposed for speech enhancement and noise suppression. A spectral subtraction method, due to its simplicity, has been widely used for speech enhancement. Another known method for speech enhancement is Wiener filtering. Inverse filtering based on all-pole models has also been reported as a suitable method for noise suppression. However, the foregoing methods are not entirely satisfactory in certain relevant applications, and thus they may not perform adequately in particular implementations. From the foregoing discussion, it therefore becomes apparent that suppressing ambient background noise to improve the signal-to-noise ratio in a speech detection system is a significant consideration of system designers and manufacturers of speech detection systems.

SUMMARY OF THE INVENTION

In accordance with the present invention, a method is disclosed for suppressing background noise in a speech detection system. In one embodiment, a feature extractor in a speech detector initially receives noisy speech data that is preferably generated by a sound sensor, an amplifier and an analog-to-digital converter. In the preferred embodiment, the speech detector processes the noisy speech data in a series of individual data units called "windows" that each include sub-units called "frames".

The feature extractor responsively filters the received noisy speech into a predetermined number of frequency sub-bands or channels using a filter bank to thereby generate filtered channel energy to a noise suppressor. The filtered channel energy is therefore preferably comprised of a series of discrete channels which the noise suppressor operates on concurrently.

Next, a subspace module in the noise suppressor preferably performs a Karhunen-Loeve transformation (KLT) to generate a KLT subspace that is based on the background noise from the filtered channel energy received from the filter bank. A projection module in the noise suppressor then projects the filtered channel energy onto the KLT subspace previously created by the subspace module to generate projected channel energy.

Then, a weighting module in the noise suppressor advantageously calculates individual weighting values for each channel of the projected channel energy. In a first embodiment, the weighting module calculates weighting values whose various channel values are directly proportional to the signal-to-noise ratio (SNR) for the corresponding channel. For example, the weighting values may be equal to the corresponding channel's SNR raised to a selectable exponential power.

In a second embodiment, in order to achieve an implementation of reduced complexity and computational requirements, the weighting module calculates the individual weighting values as being equal to the reciprocal of the background noise for the corresponding channel. The weighting module therefore generates a total noise-suppressed channel energy that is the summation of each channel's projected channel energy value multiplied by that channel's calculated weighting value.

An endpoint detector then receives the noise-suppressed channel energy, and responsively detects corresponding speech endpoints. Finally, a recognizer receives the speech endpoints from the endpoint detector, and also receives feature vectors from the feature extractor, and responsively generates a recognition result using the endpoints and the feature vectors between the endpoints. The present invention thus efficiently and effectively suppressed background noise in a speech detection system.

BRIEF DESCRIPTION OF THE DRAWINGS

FIG. 1(*b*) is an exemplary waveform diagram for one embodiment of speech energy without noise energy;

FIG. 1(*c*) is an exemplary waveform diagram for one embodiment of noise energy without speech energy;

DETAILED DESCRIPTION OF THE PREFERRED EMBODIMENT

The present invention relates to an improvement in speech detection systems. The following description is presented to enable one of ordinary skill in the art to make and use the invention and is provided in the context of a patent application and its requirements. Various modifications to the preferred embodiment will be readily apparent to those skilled in the art and the generic principles herein may be applied to other embodiments. Thus, the present invention is not intended to be limited to the embodiment shown, but is to be accorded the widest scope consistent with the principles and features described herein.

The present invention includes a method for effectively suppressing background noise in a speech detection system that comprises a filter bank for separating source speech data into discrete frequency sub-bands to generate filtered channel energy, and a noise suppressor for weighting the frequency sub-bands to improve the signal-to-noise ratio of the resultant noise-suppressed channel energy. The noise suppressor preferably includes a subspace module for using a Karhunen-Loeve transformation to create a subspace based on the background noise, a projection module for generating projected channel energy by projecting the filtered channel energy onto the created subspace, and a weighting module for applying calculated weighting values to the projected channel energy to generate the noise-suppressed channel energy.

Figure 1A:
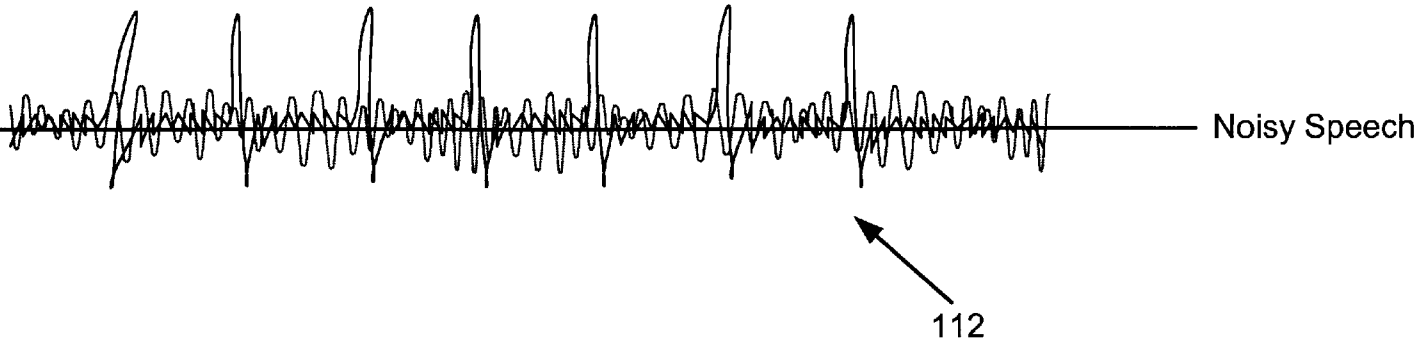
FIG. 1(*a*) is an exemplary waveform diagram for one embodiment of noisy speech energy.
Figure 1B:
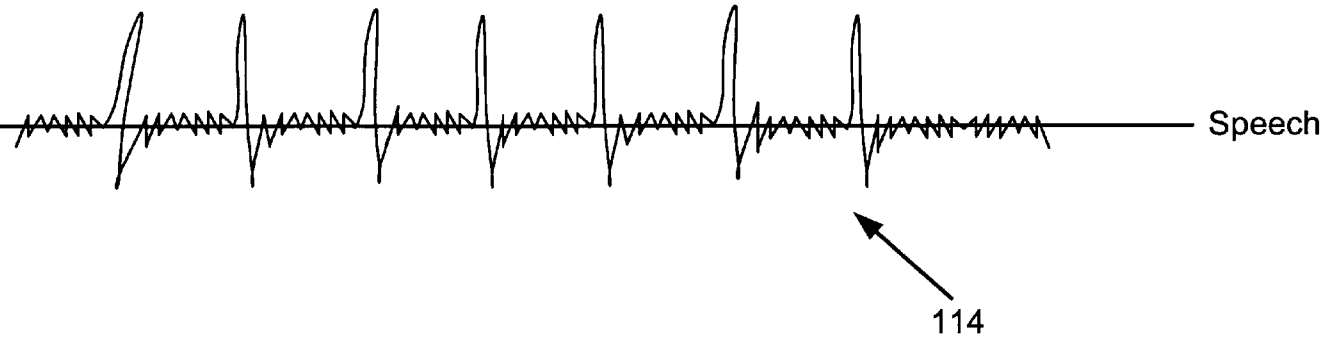
Figure 1C:
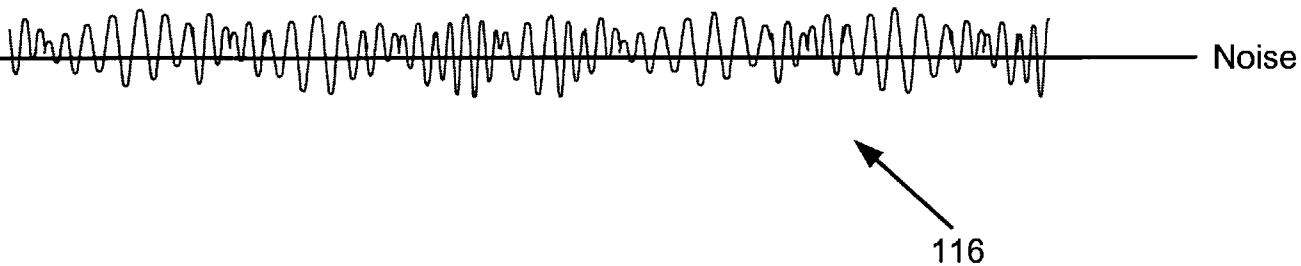
Figure 2:
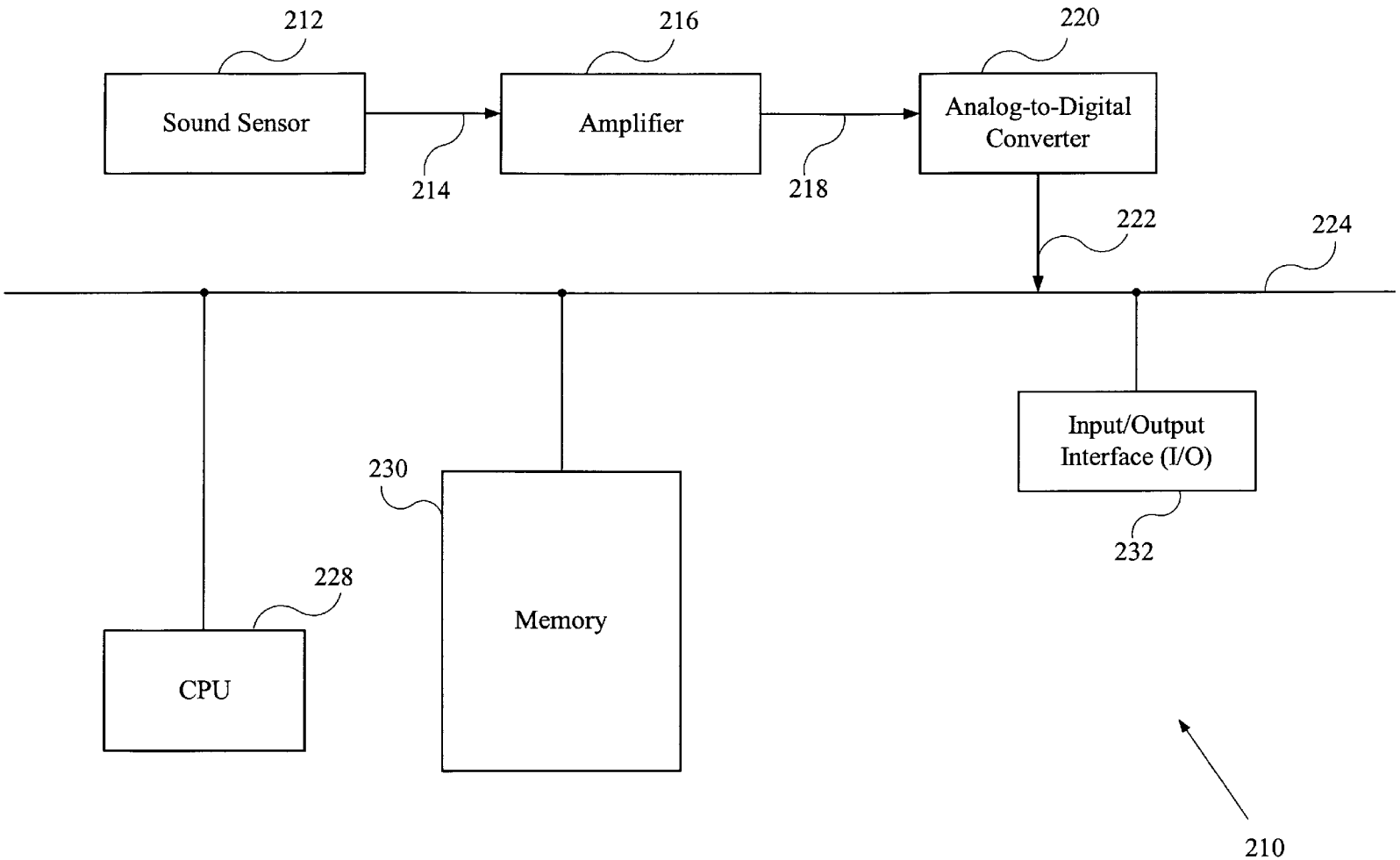
FIG. 2 is a block diagram of one embodiment for a computer system, in accordance with the present invention.

Referring now to FIG. 2, a block diagram of one embodiment for a computer system 210 is shown, in accordance with the present invention. The FIG. 2 embodiment includes a sound sensor 212, an amplifier 216, an analog-to-digital converter 220, a central processing unit (CPU) 228, a memory 230, and an input/output device 232.

In operation, sound sensor 212 detects ambient sound energy and converts the detected sound energy into an analog speech signal which is provided to amplifier 216 via line 214. Amplifier 216 amplifies the received analog speech signal and provides an amplified analog speech signal to analog-to-digital converter 220 via line 218. Analog-to-digital converter 220 then converts the amplified analog speech signal into corresponding digital speech data and provides the digital speech data via line 222 to system bus 224.

CPU 228 may then access the digital speech data on system bus 224 and responsively analyze and process the digital speech data to perform speech detection according to software instructions contained in memory 230. The operation of CPU 228 and the software instructions in memory 230 are further discussed below in conjunction with FIGS. 3–8. After the speech data is processed, CPU 228 may then advantageously provide the results of the speech detection analysis to other devices (not shown) via input/output interface 232.

Figure 3:
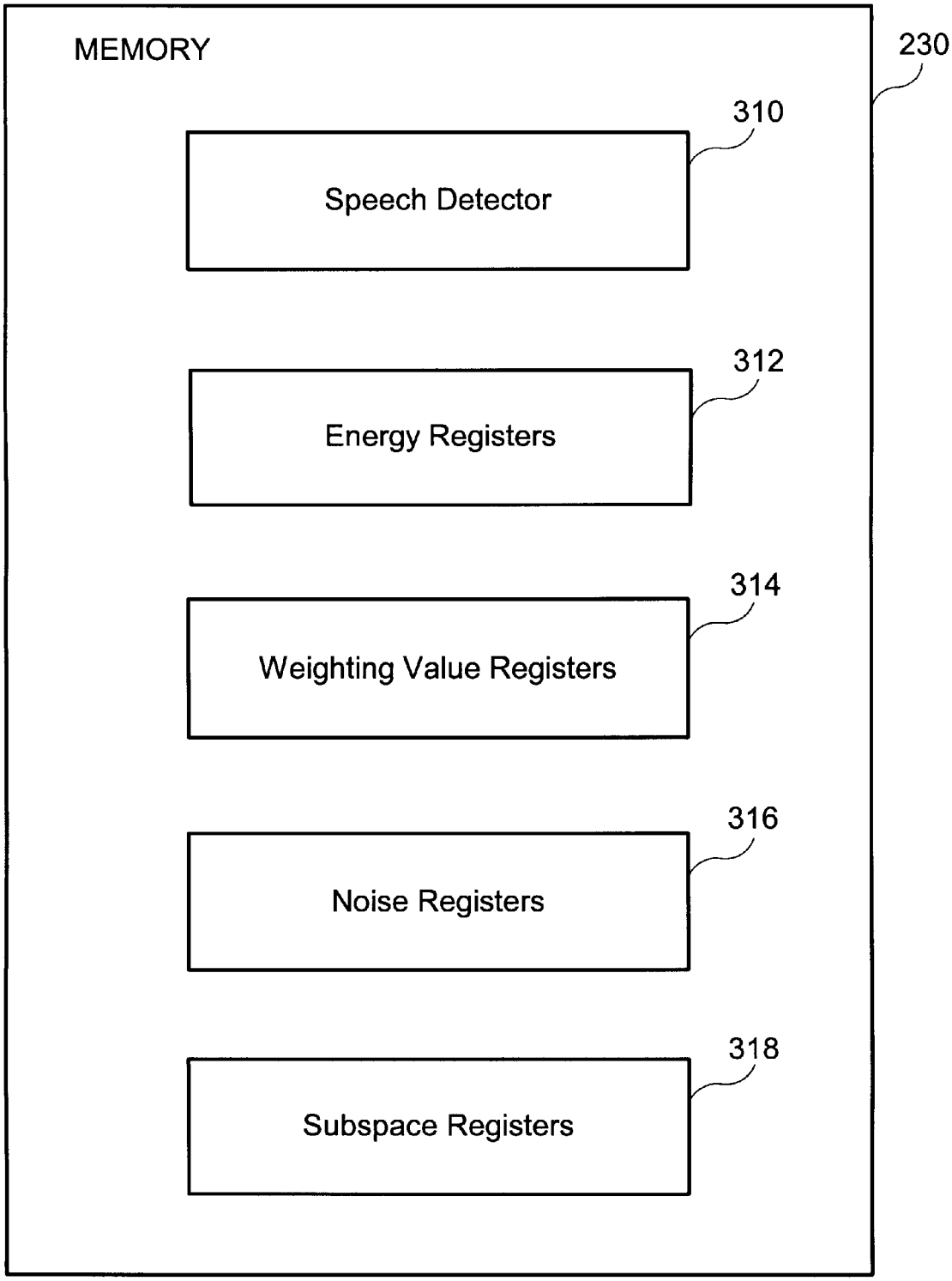
FIG. 3 is a block diagram of one embodiment for the memory of FIG. 2, in accordance with the present invention.

Referring now to FIG. 3, a block diagram of one embodiment for the FIG. 2 memory 230 is shown. Memory 230 may alternatively comprise various storage-device configurations, including Random-Access Memory (RAM) and non-volatile storage devices such as floppy-disks or hard disk-drives. In the FIG. 3 embodiment, memory 230 includes a speech detector 310, energy registers 312, weighting value registers 314, noise registers 316, and subspace registers 318.

In the preferred embodiment, speech detector 310 includes a series of software modules which are executed by CPU 228 to analyze and detect speech data, and which are further described below in conjunction with FIG. 4. In alternate embodiments, speech detector 310 may readily be implemented using various other software and/or hardware configurations. Energy registers 312, weighting value registers 314, noise registers 316, and subspace registers 318 contain respective variable values which are calculated and utilized by speech detector 310 to suppress background noise according to the present invention. The utilization and functionality of energy registers 312, weighting value registers 314, noise registers 316, and subspace registers 318 are further described below in conjunction with FIGS. 6 through 8.

Figure 4:
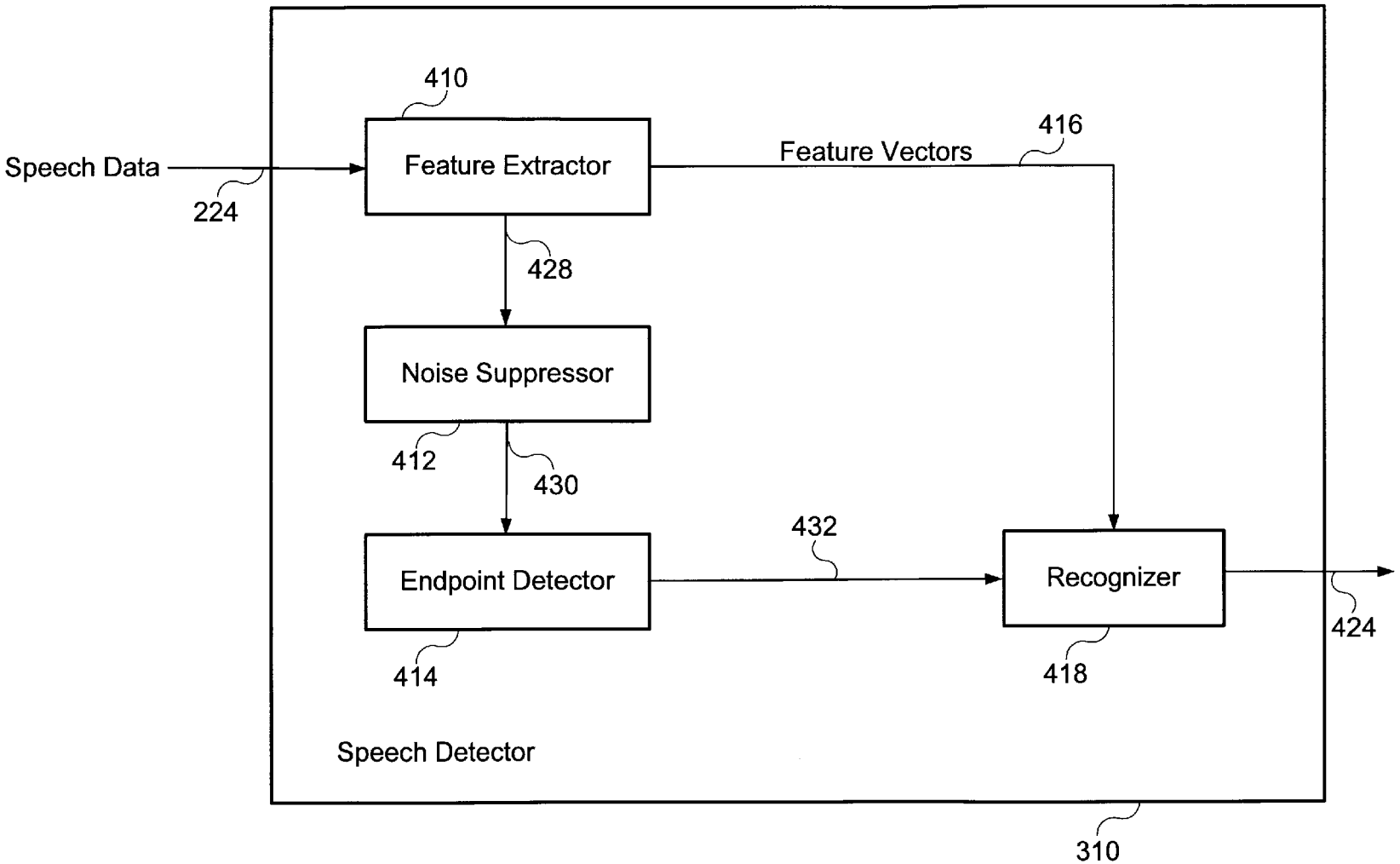
FIG. 4 is a block diagram of the one embodiment for the speech detector of FIG. 3.

Referring now to FIG. 4, a block diagram of one embodiment for the FIG. 3 speech detector 310 is shown. In the FIG. 3 embodiment, speech detector 310 includes a feature extractor 410, a noise suppressor 412, an endpoint detector 414, and a recognizer 418.

In operation, analog-to-digital converter 220 (FIG. 2) provides digital speech data to feature extractor 410 within speech detector 310 via system bus 224. A filter bank in feature extractor 410 then receives the speech data and responsively generates channel energy which is provided to noise suppressor 412 via path 428. In the preferred embodiment, the filter bank in feature extractor 410 is a mel-frequency scaled filter bank which is further described below in conjunction with FIG. 5. The channel energy from the filter bank in feature extractor 410 is also provided to a feature vector calculator in feature extractor 410 to generate feature vectors which are then provided to recognizer 418 via path 416. In the preferred embodiment, the feature vector calculator is a mel-scaled frequency capture (mfcc) feature vector calculator.

In accordance with the present invention, noise suppressor 412 responsively processes the received channel energy to suppress background noise. Noise suppressor 412 then generates noise-suppressed channel energy to endpoint detector via path 430. The functionality and operation of noise suppressor 412 is further discussed below in conjunction with FIGS. 6 through 8.

Endpoint detector 414 analyzes the noise-suppressed channel energy received from noise suppressor 412, and responsively determines endpoints (beginning and ending points) for the particular spoken utterance represented by the noise-suppressed channel energy received via path 430. Endpoint detector 414 then provides the calculated endpoints to recognizer 418 via path 432. Recognizer 418 receives feature vectors via path 416 and endpoints via path 432, and responsively performs a speech detection procedure to advantageously generate a speech detection result to CPU 228 via path 424.

Figure 5:
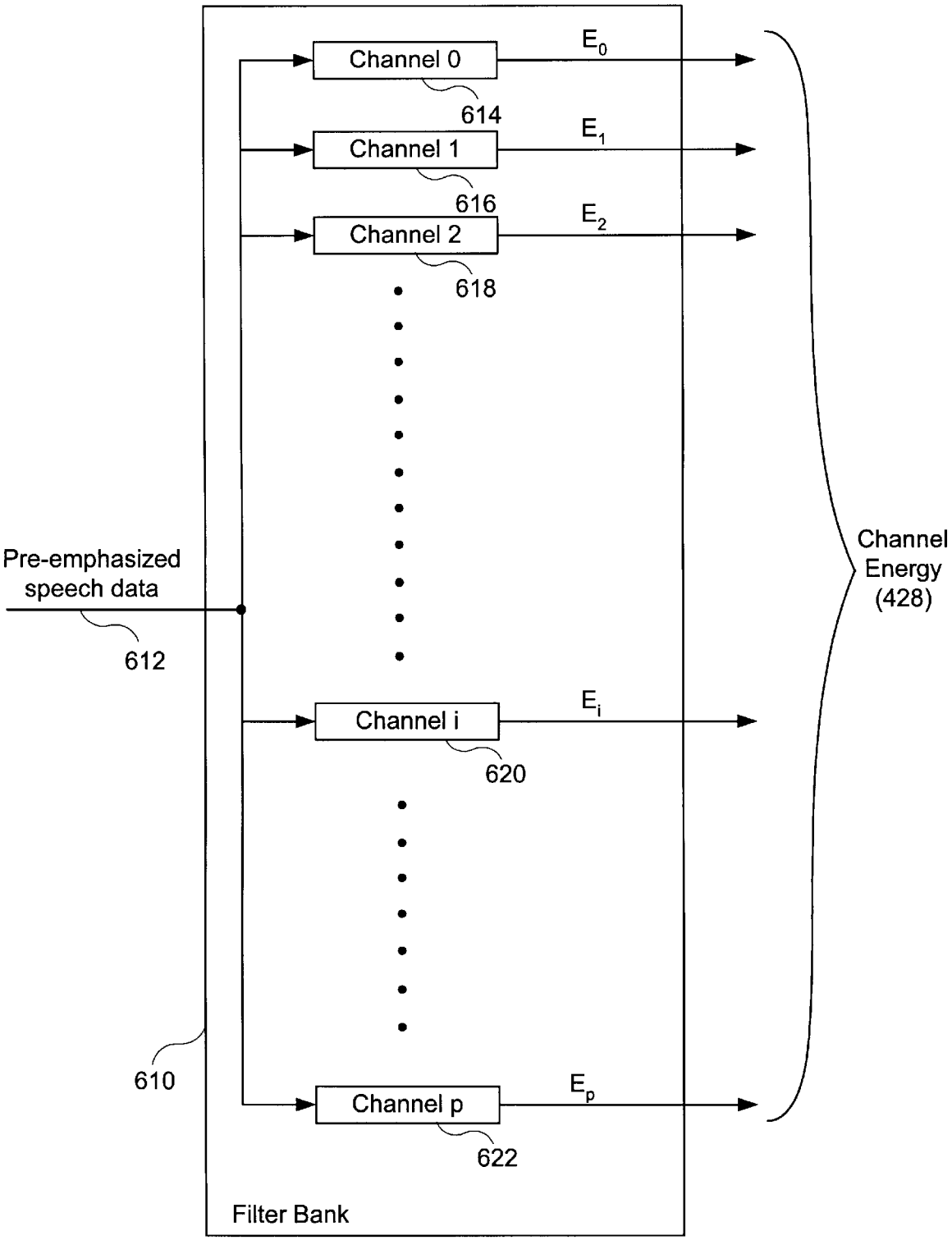
FIG. 5 is a schematic diagram of one embodiment for the filter bank of the FIG. 4 feature extractor.

Referring now to FIG. 5, a schematic diagram of one embodiment for the filter bank 610 of feature extractor 410 (FIG. 4) is shown. In the preferred embodiment, filter bank 610 is a mel-frequency scaled filter bank with "p" channels (channel 0 (614) through channel p (622)). In alternate embodiments, various other implementations of filter bank 610 are equally possible.

In operation, filter bank 610 receives pre-emphasized speech data via path 612, and provides the speech data in parallel to channel 0 (614) through channel p (622). In response, channel 0 (614) through channel p (622) generate respective channel energies $E_0$ through $E_p$ which collectively form the channel energy provided to noise suppressor 412 via path 428 (FIG. 4).

Filter bank 610 thus processes the speech data received via path 612 to generate and provide filtered channel energy to noise suppressor 412 via path 428. Noise suppressor 412 may then advantageously suppress the background noise contained in the received channel energy, in accordance with the present invention.

Figure 6:
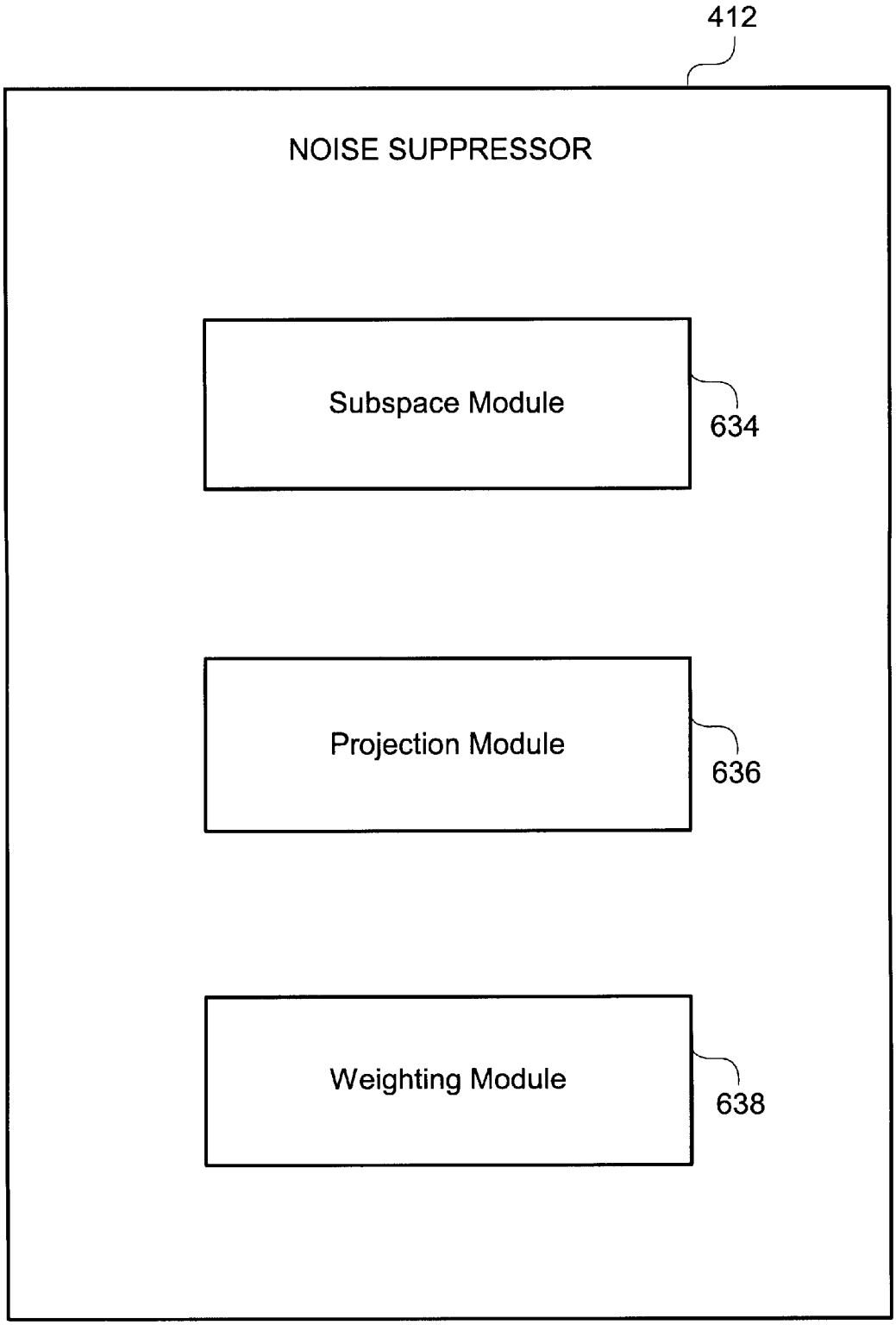
FIG. 6 is a block diagram of one embodiment for the noise suppressor of FIG. 4, in accordance with the present invention.

Referring now to FIG. 6, a block diagram of one embodiment for the FIG. 4 noise suppressor 412 is shown, in accordance with the present invention. In the FIG. 6 embodiment, noise suppressor 412 preferably includes a subspace module 634, a projection module 636, and a weighting module 638. In one embodiment of the present invention, noise suppressor 412 uses only weighting module 636 to suppress background noise and improve the signal-to-noise ratio (SNR) of the channel energy received from filter bank 610. However, in the preferred embodiment, noise suppressor 412 uses subspace module 634 and projection module 636 in conjunction with weighting module 636 to more effectively suppress background noise and improve the signal-to-noise ratio (SNR) of the channel energy received from filter bank 610. The functionality and operation of subspace module 634, projection module 636, and weighting module 638 are further discussed below in conjunction with FIGS. 6 and 7.

In the FIG. 6 embodiment, noise suppressor 412 uses a noise suppression method based on principal components analysis (otherwise known in communications theory as the Karhunen-Loeve transformation) for effective speech detection. In the FIG. 6 embodiment, noise suppressor 412 projects feature vectors from the filtered channel energy onto a subspace spanned by the eigenvectors of a correlation matrix of corresponding background noise data. Noise suppressor 412 then uses weighting module 638 to weight the projected feature vectors with weighting values adapted to the estimated background noise data to advantageously increase the SNR of the channel energy. In order to obtain a high overall SNR, the channel energy from those channels with a high SNR should be weighted highly to produce the noise-suppressed channel energy.

In other words, the weighting values calculated and applied by weighting module 638 are preferably proportional to the SNRs of the respective channel energies. Noise suppressor 412 preferably utilizes the linear Karhunen-Loeve transformation (KLT) to enhance this weighting procedure, since feature data from the filtered channels are projected onto a subspace on which the variances of noise data from the corresponding channels are maximized or minimized in their principal directions. Basic procedures of principle components analysis (or the Karhunen-Loeve transformation) are detailed in *Neural Networks, a Comprehensive Foundation,* by Simon Haykin, Macmillan Publishing Company, 1994, (in particular, pages 363–370) which is hereby incorporated by reference.

In the preferred operation of the FIG. 6 embodiment, noise suppressor 412 initially determines the channel energy for each of the channels transmitted from filter bank 610, and preferably stores corresponding channel energy values into energy registers 312 (FIG. 3). Noise suppressor 412 also determines background noise values for each of the channels transmitted from filter bank 610, and preferably stores the background noise values into noise registers 316.

Subspace module 634 then creates a Karhunen-Loeve transformation (KLT) subspace from the background noise values in noise registers 316, and preferably stores corresponding subspace values into subspace registers 318. Projection module 636 next projects the channel energy values from energy registers 312 onto the KLT subspace created by subspace module 634 to generate projected channel energy values which are preferably stored in energy registers 312. Weighting module 638 may then advantageously access the projected channel energy values and the background noise values to calculate weighting values that are preferably stored into weighting value registers 314. Finally, weighting module 638 applies the calculated weighting values to the corresponding projected channel energy values to generate noise-suppressed channel energy to endpoint detector 414, in accordance with the present invention.

The performance of the KLT by subspace module 634 and projection module 636 are illustrated in the following discussion. Let n denote an uncorrelated additive random noise vector from the background noise of the channel energy, let s be a random speech feature vector from the channel energy, and let y stand for a random noisy speech feature vector from the channel energy, all with dimension "p" to indicate the number of channels. And let $$y=S+n.$$

Assume that E[n]=0, where E is the statistical expectation operator or mean value of the channel energy. If n has a nonzero mean, then subspace module 634 simply subtracts the nonzero mean from n before continuing the analysis. The correlation matrix of the noise vector n can be expressed as $$R=E[nn^T].$$

R has its singular value decomposition expressed as $$R=V[\mathrm{diag}\lambda]V^T$$

where V is a p-by-p orthogonal matrix in the sense that its column vectors (i.e., the eigenvectors of R) satisfy the conditions of orthonormality:

$$v_i^T v_j = \begin{cases} 1 & j = i \\ 0 & j \neq i \end{cases}$$

and $\lambda$ is a p-by-1 vector defined by the eigenvalues of R $$\lambda=[\lambda_0, \lambda_1, \ldots, \lambda_{p-1}]^T.$$

Since each eigenvalue of R is equal to the variance of projection data in its corresponding principal direction, then, with a zero mean value, vector $\lambda$ also defines the average power vector of the projection data.

Figure 7:
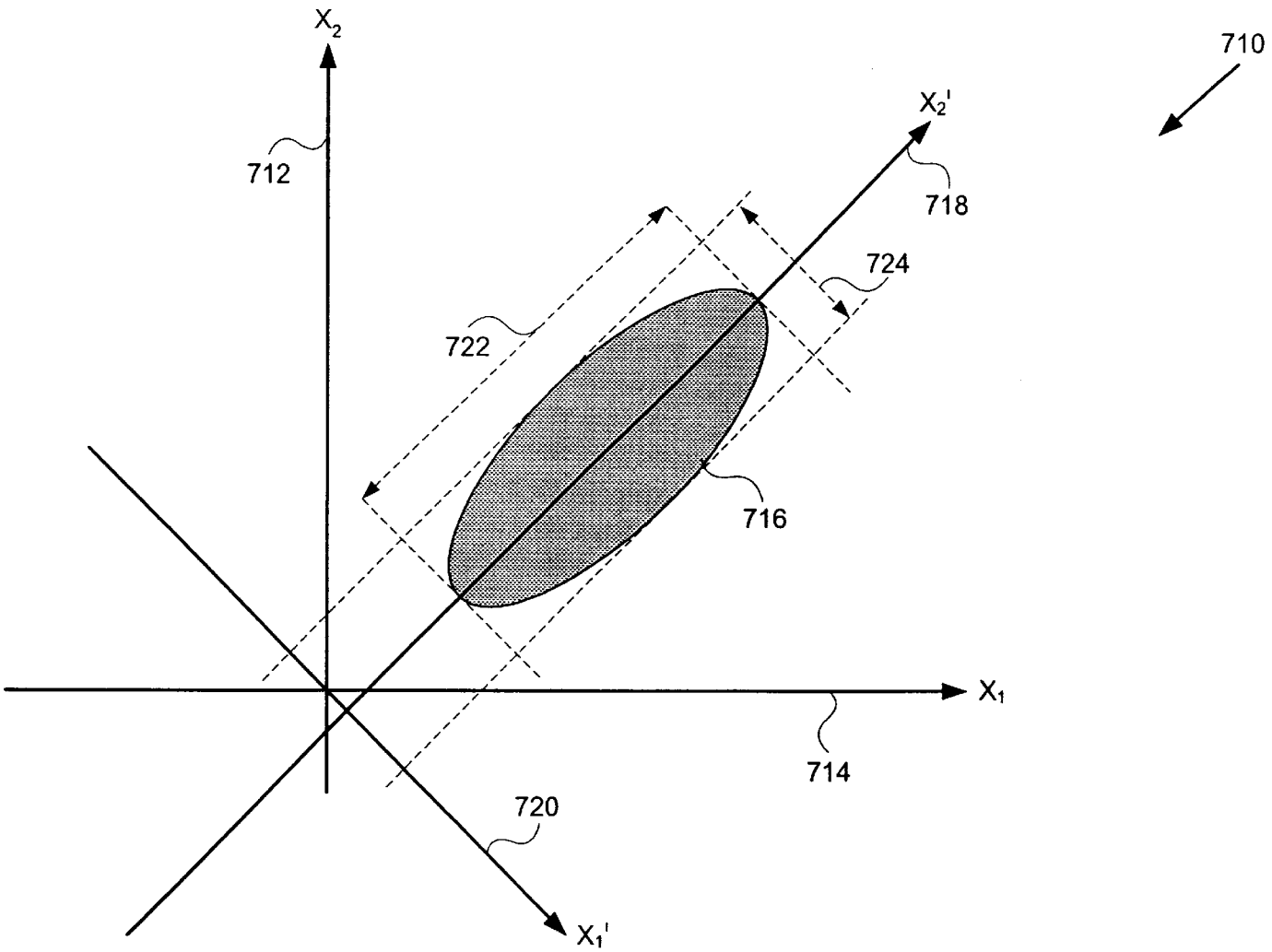
FIG. 7 is a vector diagram of one exemplary embodiment for a subspace transformation, in accordance with the present invention.

Referring now to FIG. 7, a diagram of one exemplary embodiment for a subspace transformation 710 is shown, in accordance with the present invention. For purposes of illustration and clarity, the FIG. 7 subspace transformation 710 shows background noise data 716 from only two channels of filter bank 610. Horizontal axis 714 and vertical axis 712 represent the natural coordinates of the background noise data 716, and each axis 712 and 714 corresponds to one of the two respective channels represented.

Following the KLT procedure, natural horizontal axis 714 is rotated to form a first rotated axis 720. Similarly, natural vertical axis 712 is rotated to form a second rotated axis 718. The rotated axes 718 and 720 created by subspace module 634 thus define a KLT subspace based on the background noise from two channels of the channel energy. Due to the KLT procedure, the average power of background noise data 716 is now minimized for one channel as shown by variance value 724 on axis 720.

Projection module 636 may then preferably project the channel energy values from energy registers 312 onto the KTL subspace created by subspace module 634 to generate projected channel energy values, as discussed above. In one embodiment of the present invention, projection module 636 projects the channel energy values onto the KTL subspace by multiplying the channel energy values by the corresponding eigenvector values determined during the KLT procedure. Noise suppressor 312 therefore computes the eigenvalues and eigenvectors of the correlation matrix of the background noise vector. Noise suppressor 312 then projects the speech data orthogonally onto the KLT subspace spanned by the eigenvectors.

Referring again to FIG. 6, noise suppressor 412 utilizes subspace module 634 and projection module 636 to generate projected channel energy values for each channel received from filter bank 610. Weighting module 638 then preferably calculates a weighting value for each channel and applies the weighting values to corresponding projected channel energy values to advantageously suppress background noise in speech detector 310.

Although the present invention may utilize any appropriate and compatible weighting scheme, weighting module 638 of the FIG. 6 embodiment preferably utilizes two primary weighting techniques. Let q denote a variance vector of the random speech projection vector from the channel energy projected by projection module 636 on the KLT subspace created by subspace module 634, and let q be defined by the following formula.

$$q=[\beta_0, \beta_1, \ldots, \beta_{p-1}]^T.$$

Then the signal-to-noise ratio (SNR) "$r_i$" for channel "i" may be defined as $$r_i=\beta_i/\lambda_i$$

$$i=0, 1, \ldots, p-1$$

where $\lambda$ is a p-by-1 vector defined by the eigenvalues of R (the correlation matrix of the background noise vector).

In a first embodiment, weighting module 638 provides a method for calculating weighting values "w" whose various channel values are directly proportional to the SNR for the corresponding channel. Weighting module 638 may thus calculate weighting values using the following formula.

$$w_i=(r_i)^\alpha$$

$$i=0, 1, \ldots p-1$$

where $\alpha$ is a selectable constant value.

In a second embodiment, in order to achieve an implementation of reduced complexity and computational requirements, weighting module 638 sets the variance vector of the projected speech q to the unit vector, and sets the value $\alpha$ to 1. The weighting value for a given channel thus becomes equal to the reciprocal of the background noise for that channel. According to the second embodiment of weighting module 638, the weighting values "$w_i$" may be defined by the following formula.

$$w_i=1/n_i$$

$$i=0, 1, \ldots p-1$$

where "n" is the background noise for a given channel "i".

Weighting module 638 therefore generates noise-suppressed channel energy that is the summation of each channel's projected channel energy value multiplied by that channel's calculated weighting value "$w_i$".

The total noise-suppressed channel energy "$E_T$" may therefore be defined by the following formula.

$$E_T=\Sigma w_i{*}E_i$$

$$i=0, 1, \ldots p-1$$

Figure 8:
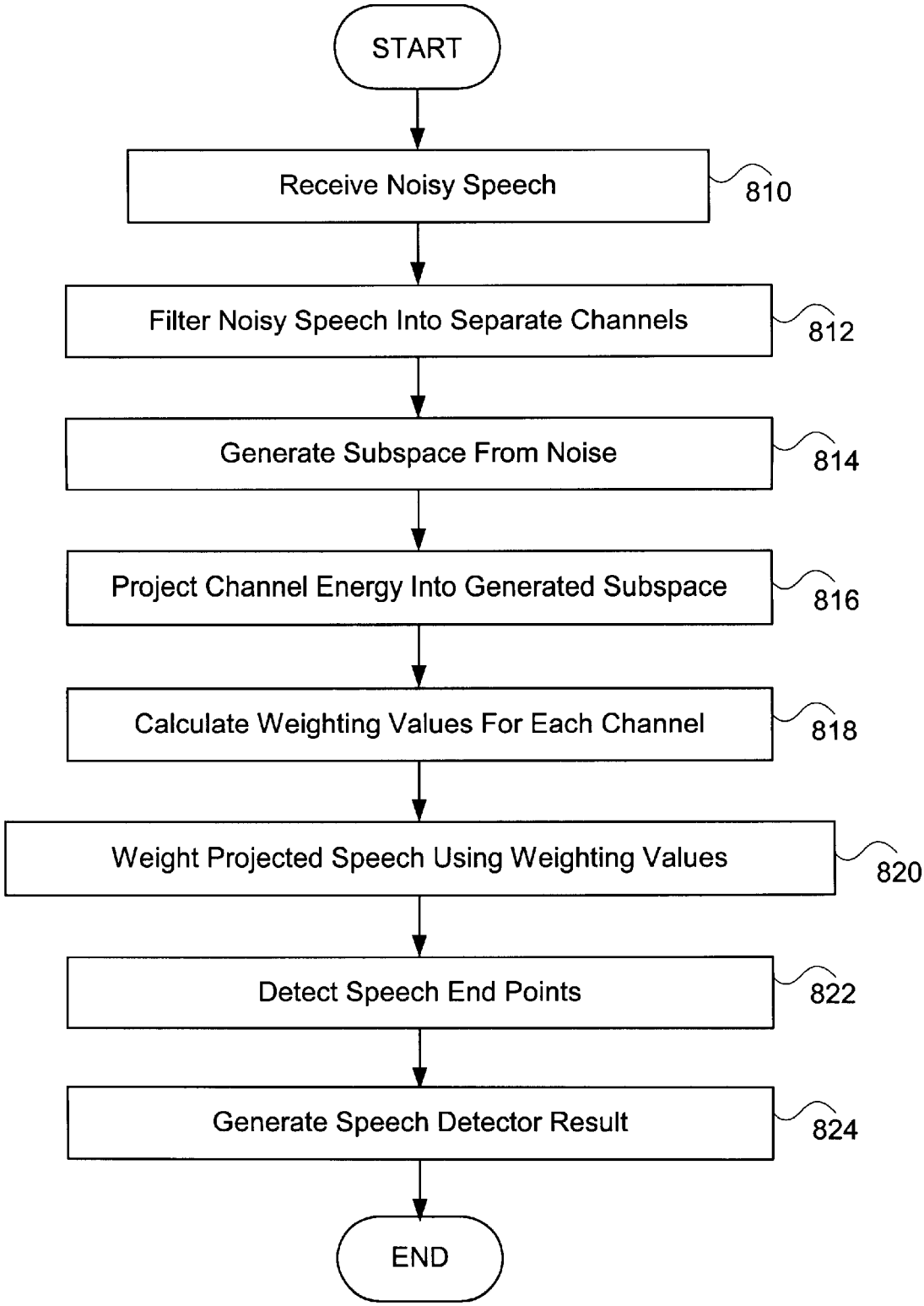
FIG. 8 is a flowchart for one embodiment of method steps for suppressing background noise in a speech detection system, in accordance with the present invention.

Referring now to FIG. 8, a flowchart for one embodiment of method steps for suppressing background noise in a speech detection system is shown, in accordance with the present invention. In step 810 of the FIG. 8 embodiment, feature extractor 410 of speech detector 310 initially receives noisy speech data that is preferably generated by sound sensor 212, and that is then processed by amplifier 216 and analog-to-digital converter 220. In the preferred embodiment, speech detector 310 processes the noisy speech data in a series of individual data units called "windows" that each include sub-units called "frames".

In step 812, feature extractor 410 filters the received noisy speech into a predetermined number of frequency sub-bands or channels using a filter bank 610 to thereby generate filtered channel energy to a noise suppressor 412. The filtered channel energy is therefore preferably comprised of a series of discrete channels, and noise suppressor 412 operates on each channel concurrently.

In step 814, a subspace module 634 in noise suppressor 412 preferably performs a Karhunen-Loeve transformation (KLT) to generate a KLT subspace that is based on the background noise from the filtered channel energy received from filter bank 610. Then, in step 816, a projection module 636 in noise suppressor 412 projects the filtered channel energy onto the KLT subspace previously created by subspace module 634 to generate projected channel energy.

Next, in step 818, a weighting module 638 in noise suppressor 412 calculates weighting values for each channel of the projected channel energy. In a first embodiment, weighting module 638 calculating weighting values whose various channel values are directly proportional to the SNR for the corresponding channel. For example, the weighting values may be equal to the corresponding channel's SNR raised to a selectable exponential power.

In a second embodiment, weighting module 638 calculates the individual weighting values as being equal to the reciprocal of the background noise for that corresponding channel. Weighting module 638 therefore generates noise-suppressed channel energy that is the sum of each channel's projected channel energy value multiplied by that channel's calculated weighting value.

In step 822, an endpoint detector 414 receives the noise-suppressed channel energy, and responsively detects corresponding speech endpoints. Finally, in step 824, a recognizer 418 receives the speech endpoints from endpoint detector 414 and feature vectors from feature extractor 410, and responsively generates a result signal from speech detector 310.

The invention has been explained above with reference to a preferred embodiment. Other embodiments will be apparent to those skilled in the art in light of this disclosure. For example, the present invention may readily be implemented using configurations and techniques other than those described in the preferred embodiment above. Additionally, the present invention may effectively be used in conjunction with systems other than the one described above as the preferred embodiment. Therefore, these and other variations upon the preferred embodiments are intended to be covered by the present invention, which is limited only by the appended claims.

What is claimed is:

1. A system for suppressing background noise in audio data, comprising:

a detector configured to perform a manipulation process on said audio data, said audio data including speech information, said detector including a speech detector configured to analyze and manipulate said speech information, wherein a first amplitude of said speech information is divided by a second amplitude of said background noise to generate a signal-to-noise ratio for said speech detector, said speech information including digital source speech data that is provided to said speech detector by an analog sound sensor and an analog-to-digital converter, wherein a filter bank generates filtered channel energy by separating said digital source speech data into discrete frequency channels, said speech detector comprising a noise suppressor, a projection module, and a weighting module, said noise suppressor including a subspace module for creating a subspace based upon said background noise, said projection module generating projected channel energy by projecting said filtered channel energy onto said subspace, said weighting module generating noise-suppressed channel energy by applying separate weighting values to each of said discrete frequency channels of said projected channel energy, said separate weighting values being proportional to said signal-to-noise ratios of said discrete frequency channels; and a processor coupled to said system to control said detector and thereby suppress said background noise.

2. The system of claim 1 wherein said weighting module calculates a weighting value "$w_i$" for a channel "i" using a formula:

$$w_i=(r_i)^{\alpha}$$

$$i=0, 1, \ldots p-1$$

where $\alpha$ is a selectable constant value, p is a total number of channels from said filter bank, and $r_i$ is said signal-to-noise ratio for said channel "i" from said filter bank.

3. The system of claim 1 wherein said weighting module calculates a weighting value "$w_i$" for a channel "i" using a formula:

$$w_i=1/n_i$$

$$i=0, 1, \ldots p-1$$

where "$n_i$" is said background noise for said channel "i" from said filter bank, and p is a total number of channels from said filter bank.

4. The system of claim 1 wherein said noise-suppressed channel energy "$E_T$" equals a summation of said projected channel energy from each of said discrete frequency channels "$E_i$" multiplied by a corresponding one of said weighting values "$w_i$".

5. The system of claim 4 wherein said noise-suppressed channel energy "$E_T$" is defined by a formula:

$$E_T=\Sigma w_i{*}E_i$$

$$i=0, 1, \ldots p-1.$$

6. The system of claim 1 wherein an endpoint detector analyzes said noise-suppressed channel energy to generate an endpoint signal.

7. The system of claim 6 wherein a recognizer analyzes said endpoint signal and feature vectors from a feature extractor to generate a speech detection result for said speech detector.

8. A method for suppressing background noise in audio data, comprising the steps of:

performing a manipulation process on said audio data using a detector, said audio data including speech information, said detector including a speech detector configured to analyze and manipulate said speech information, wherein a first amplitude of said speech information is divided by a second amplitude of said background noise to generate a signal-to-noise ratio for said speech detector, said speech information including digital source speech data that is provided to said speech detector by an analog sound sensor and an analog-to-digital converter, wherein a filter bank generates filtered channel energy by separating said digital source speech data into discrete frequency channels, said speech detector comprising a noise suppressor, a projection module, and a weighting module, said noise suppressor including a subspace module for creating a subspace based upon said background noise, said projection module generating projected channel energy by projecting said filtered channel energy onto said subspace, said weighting module generating noise-suppressed channel energy by applying separate weighting values to each of said discrete frequency channels of said projected channel energy, said separate weighting values being proportional to said signal-to-noise ratios of said discrete frequency channels; and controlling said detector with a processor to thereby suppress said background noise.

9. The method of claim 8 wherein said weighting module calculates a weighting value "$w_i$" for a channel "i" using a formula:

$$w_i=(r_i)^{\alpha}$$

$$i=0, 1, \ldots p-1$$

where $\alpha$ is a selectable constant value, p is a total number of channels from said filter bank, and $r_i$ is said signal-to-noise ratio for said channel "i" from said filter bank.

10. The method of claim 8 wherein said weighting module calculates a weighting value "$w_i$" for a channel "i" using a formula:

$$w_i=1/n_i$$

$$i=0, 1, \ldots p-1$$

where "$n_i$" is said background noise for said channel "i" from said filter bank, and p is a total number of channels from said filter bank.

11. The method of claim 8 wherein said noise-suppressed channel energy "$E_T$" equals a summation of said projected channel energy from each of said discrete frequency channels "$E_i$" multiplied by a corresponding one of said weighting values "$w_i$".

12. The method of claim 11 wherein said noise-suppressed channel energy "$E_T$" is defined by a formula:

$$E_T=\Sigma w_i{}^*E_i$$

$$i=0, 1, \ldots p-1.$$

13. The method of claim 8 wherein an endpoint detector analyzes said noise-suppressed channel energy to generate an endpoint signal.

14. The method of claim 13 wherein a recognizer analyzes said endpoint signal and feature vectors from a feature extractor to generate a speech detection result for said speech detector.

15. A system for suppressing background noise in audio data, comprising:

a detector configured to perform a manipulation process on said audio data, said audio data including speech information, said detector including a speech detector configured to analyze and manipulate said speech information, wherein a first amplitude of said speech information is divided by a second amplitude of said background noise to generate a signal-to-noise ratio for said speech detector, said speech information including digital source speech data that is provided to said speech detector by an analog sound sensor and an analog-to-digital converter, wherein a filter bank generates filtered channel energy by separating said digital source speech data into discrete frequency channels, said speech detector comprising a noise suppressor, said noise suppressor including a subspace module, a projection module, and a weighting module, said subspace module creating a subspace based upon said background noise by using a Karhunen-Loeve transformation, said projection module generating projected channel energy by projecting said filtered channel energy onto said subspace, said weighting module generating noise-suppressed channel energy by applying separate weighting values to each of said discrete frequency channels of said projected channel energy, said separate weighting values being proportional to said signal-to-noise ratios of said discrete frequency channels; and a processor coupled to said system to control said detector and thereby suppress said background noise.

16. A method for suppressing background noise in audio data, comprising the steps of:

performing a manipulation process on said audio data using a detector, said audio data including speech information, said detector including a speech detector configured to analyze and manipulate said speech information, wherein a first amplitude of said speech information is divided by a second amplitude of said background noise to generate a signal-to-noise ratio for said speech detector, said speech information including digital source speech data that is provided to said speech detector by an analog sound sensor and an analog-to-digital converter, wherein a filter bank generates filtered channel energy by separating said digital source speech data into discrete frequency channels, said speech detector comprising a noise suppressor, said noise suppressor including a subspace module, a projection module, and a weighting module, said subspace module creating a subspace based upon said background noise by using a Karhunen-Loeve transformation, said projection module generating projected channel energy by projecting said filtered channel energy onto said subspace, said weighting module generating noise-suppressed channel energy by applying separate weighting values to each of said discrete frequency channels of said projected channel energy, said separate weighting values being proportional to said signal-to-noise ratios of said discrete frequency channels; and controlling said detector with a processor to thereby suppress said background noise.

* * * * *